United States Patent [19]

Jay et al.

[11] 4,177,156

[45] Dec. 4, 1979

[54] DIELECTRIC COMPOSITIONS COMPRISING MIXTURES OF POLYCHLORINATED BENZENES AND ALKYLAROMATIC HYDROCARBONS

[75] Inventors: Pierre Jay, Saint-Didier Au Mont D'Or; Pierre Bonhomme, Meyzieu, both of France

[73] Assignee: Rhone-Poulenc Industries, Paris, France

[21] Appl. No.: 885,381

[22] Filed: Mar. 10, 1978

[30] Foreign Application Priority Data

Mar. 10, 1977 [FR] France ..... 77 08080

[51] Int. Cl.[2] ..... C10M 3/24; H01B 3/24; H01B 3/22

[52] U.S. Cl. ..... 252/66; 252/63; 336/58; 361/317; 361/327

[58] Field of Search ..... 252/63, 66, 77; 336/58; 361/317, 327

[56] References Cited

U.S. PATENT DOCUMENTS

| | | | |
|---|---|---|---|
| 1,999,004 | 4/1935 | Clark | 361/327 X |
| 2,508,099 | 5/1960 | Clark | 252/63 |
| 2,837,724 | 6/1958 | Cook | 336/58 |
| 3,194,766 | 7/1965 | Coquillion | 252/66 |
| 3,844,968 | 10/1974 | Jay | 252/66 |
| 4,119,555 | 10/1978 | Jay | 252/66 |

*Primary Examiner*—P. E. Willis, Jr.

*Attorney, Agent, or Firm*—Burns, Doane, Swecker & Mathis

[57] ABSTRACT

Liquid, non-flammable dielectric compositions especially adapted as insulators/coolants for transformers are comprised of [1] a mixture of polychlorobenzenes, including a major amount of an at least trichlorinated benzene and a minor amount of ortho-dichlorobenzene, and [2] an alkylaromatic hydrocarbon or a partially hydrogenated bi- or terphenyl.

19 Claims, 1 Drawing Figure

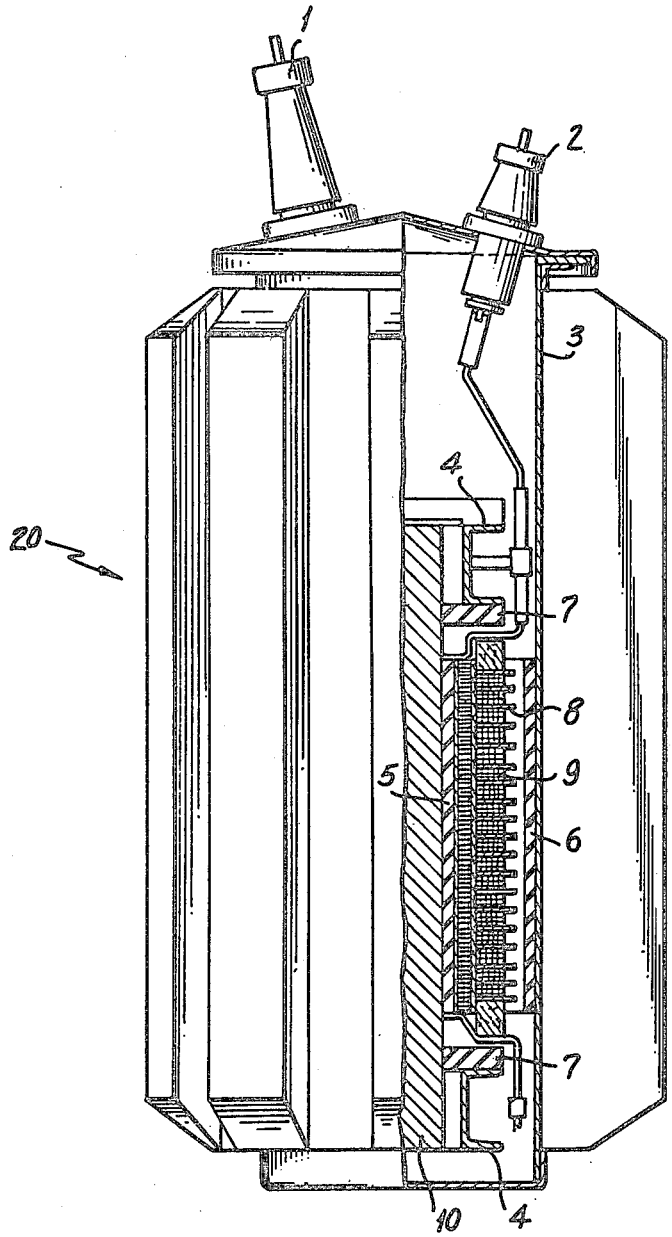
1
2
3
4
20
7
8
5
9
6
7
10
4

DIELECTRIC COMPOSITIONS COMPRISING MIXTURES OF POLYCHLORINATED BENZENES AND ALKYLAROMATIC HYDROCARBONS

CROSS REFERENCE TO RELATED APPLICATION

Copending application, Ser. No. 804,738, filed June 8, 1977, now U.S. Pat. No. 4,119,555, assigned to the assignee of the present application.

BACKGROUND OF THE INVENTION

1. Field of the Invention

The present invention relates to novel, liquid, non-flammable dielectric compositions, and, more specifically, to such dielectric compositions well suited as insulators/coolants for electrical transformers.

2. Description of the Prior Art

It is art recognized that the dielectric liquids utilized in transformers perform a dual function. On the one hand, they serve as insulating liquids and, in this respect, they must conform to certain pre-determined requirements regarding their electrical properties, especially their dielectric strength and coefficient of dissipation. On the other hand, they concurrently serve as a cooling agent for the apparatus, and they must thus ensure excellent elimination and dissipation of the heat generated during operation of the transformer. This latter function cannot be successfully fulfilled unless the agent employed exhibits, under the very variable conditions of use of the transformer, a sufficiently low viscosity for the liquid as to enable same to readily dissipate the heat evolved. It is also art recognized that transformers may have to function at extremely low temperatures, for example, below 0° C., and even as low as −40°. C. It is thus important that at these extreme temperatures the dielectric should remain a liquid, at least partially, having a sufficient fluidity and should, furthermore, not give rise to complete crystallization, such that any crystals which indeed are formed during periods of prolonged exposure to low temperatures remain impregnated with, and surrounded by, the liquid, thus preventing any air from penetrating into the working parts of the transformer.

In addition to these properties, it is also necessary, for certain types of transformers, that the dielectric liquids should be non-flammable. In fact, under the conditions of operation of the transformers, a destruction of the dielectric can occur, with the production of an electric arc which may be of very high power. This breakdown arc decomposes the liquid or solid dielectrics and can ignite the liquid and/or the gases evolved, whether these are decomposition products of the dielectric or of the vapors thereof. It is thus important that the dielectric liquid and its vapors, or the decomposition gases produced in the event of a fault in operation of the apparatus, should not ignite. In general, this resistance to ignition is assessed in terms of the flash point or the ignition point of the liquid in question.

Numerous liquid dielectrics for transformers which, to a greater or lesser extent, exhibit all of the properties enumerated above have been proposed. Among these products, there may be mentioned the "Askarels" which have been proven most satisfactory and which are used most widely. Same are biphenyl or terphenyl chlorination products containing from 3 to 7 chlorine atoms, which are most preferably employed in the form of admixture with one other or with other chlorinated aromatic hydrocarbons, and especially with the trichlorobenzenes and tetrachlorobenzenes. In spite of their demonstrated value, these particular dielectrics exhibit the severe disadvantage that they cannot be degraded biochemically and are difficult to degrade chemically. This stability of the polychlorobiphenyls presents serious hazards from an environment pollution standpoint, such that a need is becoming increasingly more evident for products having as short a life as possible, in nature, as a result of being increasingly chemically or biochemically degradable. Such products which exhibit both the aforementioned technical properties, as well as enhanced degradability, were hiterto uncommon to the industry.

SUMMARY OF THE INVENTION

It has now been found that certain compositions are especially well adapted as insulator/coolant dielectric liquids for transformers, which dielectrics:

[i] neither fully crystallize nor do they set solid under typical service conditions; in particular, same do not effect complete deposits of crystals at temperatures below or equal to −10° C., i.e., they remain wholly or partially liquid at such temperatures;

[ii] are non-flammable;

[iii] have a low viscosity under typical conditions of use and, in particular, have a viscosity which is usually below 15 cPo at 60° C.;

[iv] have excellent dielectric properties; and

[v] are degradable in the event of pollution of the environment.

More specifically, the above and other objects of the present invention are attained by providing certain dielectric liquids for transformers, characterized in that same comprise:

[1] 75% to 90% by weight of a mixture comprising:

(a) from 75 to 95% by weight of at least one polychlorobenzene which has at least 3 chlorine atoms and which is selected from the group consisting of the tri- and tetrachlorobenzenes, and (b) from 25 to 5% by weight of ortho-dichlorobenzene; and

[2] 25 to 10% by weight of a fraction containing at least one hydrocarbon selected from the group consisting of mono- or poly-alkylbiphenyls, mono- or poly-alkylterphenyls, in which the alkyl substituent contains 1 to 5 carbon atoms, and bi- or ter-phenyls which are at least partially hydrogenated.

BRIEF DESCRIPTION OF THE DRAWING

The FIGURE of drawing is a vertical cross-section, partly in elevation, of a transformer which has been insulated according to the invention.

DETAILED DESCRIPTION OF THE INVENTION

Even more particularly, the expression hydrogenated bi- or terphenyls is used herein to denote those reaction mixtures which are obtained by hydrogenating, in accordance with known processes, biphenyl or terphenyls (whether taken by themselves or, preferably, mixed with one another, such as, for example, mixtures of ortho-terphenyl and/or meta-terphenyl and/or para-terphenyl), and which can contain non-hydrogenated bi- or terphenyls; these are, therefore, admixtures displaying very different degrees of hydrogenation. The term "degree of hydrogenation" denotes the fraction, relative to 100, of the number of hydrogen atoms which are theoretically required to ensure complete hydrogenation of the aromatic nuclei of the bi- or terphenyls. Advantageously, products are used which have a degree of hydrogenation of at least 10% and at most 40%.

The alkylaromatic hydrocarbons which can be used in the dielectric compositions according to the invention correspond to those of the following formulae:

[I]

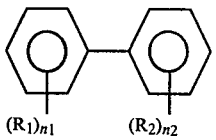

[II]

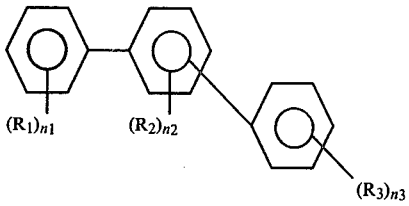

in which:

$R_1$, $R_2$ and $R_3$ represent identical or different linear or branched chain alkyl radicals containing from 1 to 5 carbon atoms and preferably from 2 to 4 carbon atoms, and $n_1$, $n_2$ and $n_3$, which may be identical or different, represent 0 or a number from 1 to 3, with the proviso that at least one of the indices $n_1$, $n_2$ and $n_3$ is at least equal to 1 and that, in the formula [I] compounds, the sum $n_1+n_2$ is at most equal to 5 and in the formula [II] compounds the sum $n_1+n_2+n_3$ is at most equal to 4.

As specific examples of the radicals $R_1$, $R_2$ and $R_3$, there may be mentioned the methyl, ethyl, n-propyl, isopropyl, n-butyl, isobutyl, t-butyl and n-pentyl radicals. Preferably, $R_1$, $R_2$ and $R_3$ represent ethyl, propyl and butyl radicals, and, more preferably, isopropyl and t-butyl radicals.

The alkylbiphenyls and alkylterphenyls comprising the liquid dielectrics according to the invention are known products obtained by alkylation of biphenyls and terphenyls by means of the usual alkylating agents, such as the alkyl halides, the aliphatic olefins containing from 1 to 5 carbon atoms or the alkanols, in the presence of the usual catalysts for Friedel-Crafts reactions. Because of their valuable physical and dielectric properties, these compounds are used as cooling liquids and the use of certain of same as dielectrics has even been proposed [compare U.S. Pat. No. 2,837,724]. However, because of their flammability, the alkylbiphenyls and alkylterphenyls are not used in practice as non-flammable dielectrics and coolants for transformers.

Depending on their physical state at low temperatures, the alkylbiphenyls and alkylterphenyls can be used in the pure state, or in the form of mixtures of isomers and/or of products with varying degrees of alkylation obtained in the course of their preparation. It is, in particular, possible to use the crude mixtures resulting from the alkylation of biphenyl and the terphenyls, which mixtures can, where appropriate, contain the unconverted starting material biphenyl and terphenyl, in addition to the reaction products. In all cases, it is preferable that the degree of alkylation of the mixture represented by the number of alkyl groups per molecule is at least 0.5 and preferably at least 1.

Among the alkylbiphenyls and alkylterphenyls which, depending on the particular case, can be used by themselves or as mixtures with one another, the following may be mentioned as non-limiting examples: 2-ethylbiphenyl, 4-ethylbiphenyl, 4,4'-diethylbiphenyl, the triethylbiphenyls, 2-propylbiphenyl, 4-propylbiphenyl, 2-isopropylbiphenyl, 3-isopropylbiphenyl, 4-isopropylbiphenyl, 3,3'-dipropylbiphenyl, 4,4'-dipropylbiphenyl, 2,2'-diisopropylbiphenyl, 4,4'-diisopropylbiphenyl, 3,3',5,5'-tetraisopropylbiphenyl, 2-n-butylbiphenyl, 3-n-butylbiphenyl, 4-n-butylbiphenyl, 3-sec-butylbiphenyl, 4-sec-butylbiphenyl, 2,2'-di-t-butylbiphenyl, 4,4'-di-t-butylbiphenyl, 3,5-di-5-butylbiphenyl, 4,4'-di-sec-butylbiphenyl, 2,4,6-tri-t-butylbiphenyl, 3,3',5,5'-tetra-t-butylbiphenyl, 4-sec-butyl-4'-t-butylbiphenyl, sec-butyl-di-t-butylbiphenyl, 4'-isopropyl-metaterphenyl, 4'-butyl-meta-terphenyl, 5'-butyl-meta-terphenyl, diisopropyl-meta-terphenyl, 2,2''-diethyl-meta-terphenyl,2,-3''-diethyl-meta-terphenyl, 4,4''-diethyl-meta-terphenyl, triisopropyl-meta-terphenyl, 4-isopropyl-ortho-terphenyl, 4-butylortho-terphenyl, di-isopropyl-para-terphenyl, tri-isopropylpara-terphenyl and 4,4'-dibutyl-para-terphenyl.

It is also possible to use, without departing from the scope of the present invention, the products resulting from the alkylation of mixtures of 2 or of 3 of the isomeric terphenyls. In particular, it is possible to employ mixtures of two or three isomeric terphenyls or of biphenyl with terphenyls.

The trichlorobenzenes and tetrachlorobenzenes used in the dielectric liquids which constitute the subject of the present invention are known products of melting point above 17° C. In spite of their good dielectric properties and their non-flammability, these chlorobenzenes have not been used in and of themselves as dielectrics because of their excessively high crystallization points. 1,2,4-Trichlorobenzene and 1,2,3,4-tetrachlorobenzene have been used as additives in dielectrics, or in customary cooling liquids, such as polychlorobeiphenyls, in order to lower the solidification point [compare Ullman, *Encyclopädie der Technischen Chemie,* 5, page 468 (1954); Kirk-Othmer, *Encyclopedia of Chemical Technology,* 5, page 265 (1964); German Pat. No. 687,712]. The use of mixtures of trichlorobenzenes as dielectric liquids has also been disclosed, but these compositions, which principally comprise 1,2,3-trichlorobenzene and 1,2,4-trichlorobenzene, and small amounts of other chlorobenzenes (dichlorobenzenes and tetrachlorobenzenes) still have crystallization points which are too high for the compositions to be used in transformers. Thus, the eutectic mixture of 1,2,3-trichlorobenzene and 1,2,4-trichlorobenzene, which contains 34% and 66% of the two isomers, respectively, has a crystallization point of +1.5° C. [compare Ullman, *Encyclopädie der Technischen Chemie,* 9, page 500 (1975)].

Among the trichlorobenzenes and tetrachlorobenzenes which can be used in the component [1] of the compositions defined above, it is preferred to employ 1,2,3-trichlorobenzene and 1,2,4-trichlorobenzene and 1,2,3,4-tetrachlorobenzene. These compounds can be used by themselves or mixed with one another; in the latter case, the proportions of each of the constituents are not critical and can vary over wide limits. For example, in these mixtures each compound can represent from 1 to 99% by weight of the total weight. However, for practical reasons it is preferred to use the eutectic mixtures of 1,2,3-trichlorobenzene/1,2,4-trichlorobenzene, or 1,2,3-trichlorobenzene/1,2,4-trichlorobenzene/1,2,3,4-tetrachlorobenzene, and the eutectic mixtures formed by tetrachlorobenzene with each of the above-mentioned trichlorobenzenes.

The proportions of the components [1] and [2], respectively, in the compositions according to the invention depend both on the proportion by weight of the ortho-dichlorobenzene fraction (b) and on the degree of alkylation or hydrogenation of the bi- or terphenyls in the component [2]. These respective proportions of component [1] and the component [2] are selected from between the aforementioned limits, so that the hydrogen index iH of the mixture [1]+[2], expressed by the weight in grams of hydrogen, relative to 1 g of the mixture [1]+[2], which can theoretically be liberated by an electric arc, is lower than 0.02. The term "hydrogen which can theoretically be liberated" denotes those hydrogen atoms in the molecule which remain after those consumed during combustion, to provide hydrochloric acid with the chlorine in the molecule, have been subtracted.

By judicious choice of the respective amounts of the components of the dielectric mixture, it is possible to obtain a range of products having all the properties listed, but to varying degrees, and consequently it is possible to regulate to an optimum degree these properties in accordance with the type of non-flammable transformer for which the dielectric is intended.

The dielectric compositions described above may contain the usual adjuvants, such as antioxidants, thickners for adjusting the viscosity of the liquid, e.g., styrene/butadiene copolymers, and sequestering agents for the hydrochloric acid which may be liberated by decomposition of the chlorobenzenes under the operating conditions of transformers. The sequestering agents for hydrochloric acid which are employed preferably are epoxy compounds, such as those typically employed in the field of chlorinated dielectrics, among which the following may be mentioned as non-limiting examples: propylene oxide and glycidyl ethers; styrene oxide, 1,3-bis-(2,3-epoxy-propoxy)-benzene and di(2-ethylhexyl) 4,5-epoxytetrahydrophthalate. Other epoxy compounds, such as those noted in U.S. Pat. Nos. 3,362,708, 3,242,401, 3,242,402 and 3,170,986 may be used.

The amount of adjuvant incorporated into the dielectric can vary within wide limits. In general, an amount of between 0.01 and 5% by weight of the dielectric admixture is very suitable.

The dielectric compositions according to the present invention can be used as insulators for any type of electrical apparatus, such as transformers and condensers, but they are very particularly suitable for transformers.

The compositions according to the invention can be used for all types of transformers. The Figure of Drawing schematically illustrates an apparatus 20 in which the dielectric mixtures described above can be employed. The transformer represented in the figure comprises a high voltage terminal 1, a low voltage terminal 2, the transformer cell 3, clamping flanges 4, and insulating barriers 5 and 6 which respectively separate the low voltage winding 8 and the magnetic core 10, on the one hand, and the high voltage winding 9 and the transformer cell 3 on the other. The components 7 represent insulating spacers. The conductors of the low voltage and high voltage windings are insulated by a solid dielectric material, such as paper.

The transformer cell is filled with the dielectric composition. The liquid fills all of the cavities and impregnates the windings and other parts of the apparatus capable of being impregnated.

In order to further illustrate the present invention and the advantages thereof, the following specific examples are given, it being understood that same are intended only as illustrative, and in nowise limitative. In these examples, the flammable nature of the subject compositions was examined by determining the flash point and the ignition point in accordance with standard specification ASTM D 92-66, using the Cleveland open cell method, and by the test for the flammability of an atomized mist in accordance with ASTM Standard Specification D 3119-75. According to this test, a liquid is considered to be satisfactory if it gives spasmodic flames, namely if it is a liquid which ignites sporadically and gives flames which die out spontaneously. A mist which only burns near the source of the flames (fire at the source), or which does not burn, is very satisfactory.

EXAMPLES 1 to 7

A series of dielectric compositions was prepared by mixing various components, the nature and amounts of which are indicated in the Table I below; the abbreviations which follow denote, respectively:

ODCB: ortho-dichlorobenzene;

ET: eutectic mixture containing 31% by weight of 1,2,3-trichlorobenzene and 69% by weight of 1,2,4-trichlorobenzene;

ETT: eutectic ternary mixture containing 20.3% by weight of 1,2,3-trichlorobenzene, 47.3% by weight of 1,2,4-trichlorobenzene and 32.4% by weight of 1,2,3,4-tetrachlorobenzene;

IPT-2.5: isopropylterphenyl obtained by isopropylating a mixture of ortho-, meta- and para-terphenyl and containing 2.5 isopropyl groups per molecule;

IPMT-1: isopropylterphenyl obtained by isopropylating a mixture which is rich in m-terphenyl and has the following composition: 22% by weight of o-terphenyl, 75% by weight of m-terphenyl and 3% by weight of p-terphenyl, and containing one isopropyl group per molecule;

HMT-10: hydrogenated terphenyl having a degree of hydrogenation of 10% and obtained by hydrogenating the terphenyl mixture which is rich in meta-terphenyl and has the composition which has been given above; and HMT-20: hydrogenated terphenyl having a degree of hydrogenation of 20% and obtained from the same terphenyl mixture of HMT-10.

TABLE I

| | | COMPONENT A | | COMPONENT B | |
|---|---|---|---|---|---|
| EXAMPLE | DIELECTRIC NO. | COMPOSITION BY WEIGHT | % IN THE DIELECTRIC | NATURE | % IN THE DIELECTRIC |
| 1 | I | a) ET 75%<br>b) ODCB 25% | 85 | IPMT-1 | 15 |
| 2 | II | a) ETT 80% | 80 | IPT-2,5 | 20 |

TABLE I-continued

| EXAMPLE | DIELECTRIC NO. | COMPONENT A COMPOSITION BY WEIGHT | COMPONENT A % IN THE DIELECTRIC | COMPONENT B NATURE | COMPONENT B % IN THE DIELECTRIC |
|---|---|---|---|---|---|
| | | b) ODCB 20% | | | |
| 3 | III | a) ETT 80% | 85 | IPMT-1 | 15 |
| | | b) ODCB 20% | | | |
| 4 | IV | a) ETT 80% | 83.5 | IPMT-1 | 15 |
| | | b) ODCB 20% | | | |
| 5 | V | a) ETT 75% | 85 | HMT-10 | 15 |
| | | b) ODCB 25% | | | |
| 6 | VI | a) ETT 75% | 85 | HMT-20 | 15 |
| | | b) ODCB 25% | | | |
| 7 | VII | a) ETT 75% | 90 | IPMT-1 | 10 |
| | | b) ODCB 25% | | | |

(1) this mixture additionally contained 1.5% by weight of a styrene/butadiene copolymer (containing 54% by weight of styrene) which had a number average molecular weight of 120,000, a weight average molecular weight of 165,000 and which served as a thickener.

The characteristics of the dielectrics I to VII were then determined. Same are recorded in the following Table II:

TABLE II

| DIELECTRIC NO. | iH | BOILING POINTS IN °C. | VISCOSITY IN cS AT 60° C. | ASTM TEST D 3119-75 | CRYSTALLIZATION AT −30° C. |
|---|---|---|---|---|---|
| I | 0.014 | 206 | 1.3 | spasmodic flames | crystals + liquid after 30 days |
| II | 0.018 | 207 | 1.7 | spasmodic flames | a few crystals after 30 days |
| III | 0.011 | 206 | 1.3 | flames at the source | a few crystals after 12 days |
| IV | 0.013 | 206 | 4.35 | flames at the source | a few crystals after 12 days |
| V | 0.011 | 206 | | between flames at the source and spasmodic flames | copious crystals + liquid after 30 days |
| VI | 0.012 | 206 | | spasmodic flames | a few crystals after 30 days |
| VII | 0.008 | 204 | | flames at the source | a few crystals after 8 days |

These various dielectrics do not possess a flash point.

While the invention has been described and illustrated with reference to certain preferred embodiments thereof, those skilled in the art appreciate that various changes, modifications and substitutions therein can be made without departing from the spirit of the invention. It is intended, therefore, that the invention be limited only by the scope of the claims which follow.

What is claimed is:

1. A liquid, non-flammable dielectric composition, comprising [1] from 75% to 90% by weight of a mixture of polychlorobenzenes, which comprises (i) from 75% to 95% by weight an at least one polychlorobenzene having at least 3 chlorine atoms and (ii) from 25% to 5% by weight of orthodichlorobenzene, and [2] from 25% to 10% by weight of a member selected from the group consisting of (iii) an alkylaromatic hydrocarbon selected from the group consisting of a mono- or polyalkylbiphenyl, a mono- or polyalkylterphenyl, and mixtures thereof, and wherein each alkyl substituent contains from 1 to 5 carbon atoms, and (iv) a member selected from the group consisting of an at least 10% hydrogenated biphenyl and an at least 10% hydrogenated terphenyl.

2. The dielectric composition as defined by claim 1, wherein the at least one polychlorobenzene [1] (i) is selected from the group consisting of trichlorobenzene and tetrachlorobenzene.

3. The dielectric composition as defined in claim 1, wherein the sub-component [1] (i) comprises a member selected from the group consisting of 1,2,3-trichlorobenzene, 1,2,4-trichlorobenzene, 1,2,3,4-tetrachlorobenzene and mixtures thereof.

4. The dielectric composition as defined by claim 3, wherein the sub-component [1] (i) is a eutectic mixture of 1,2,3-trichlorobenzene and 1,2,4-trichlorobenzene.

5. The dielectric composition as defined by claim 3, wherein the sub-component [1] (i) is the ternary eutectic mixture of 1,2,3-trichlorobenzene/1,2,4-trichlorobenzene/1,2,3,4-tetrachlorobenzene.

6. The dielectric composition as defined by claim 2, wherein the component [2] comprises a biphenyl having the structural formula:

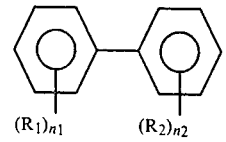

(I)

in which $R_1$ and $R_2$ represent identical or different linear or branched chain alkyl radicals containing from 1 to 5 carbon atoms, and $n_1$ and $n_2$, which may be identical or different, represent 0 or a number ranging from 1 to 3, with the proviso that at least one of the indices $n_1$ and $n_2$ is at least equal to 1 and that the sum $n_1+n_2$ is at most equal to 5.

7. The dielectric composition as defined by claim 6, wherein each $R_1$ and $R_2$ is selected from the group consisting of methyl, ethyl, n-propyl, isopropyl, n-butyl, isobutyl, sec-butyl and t-butyl.

8. The dielectric composition as defined by claim 2, wherein the component comprises [2] a terphenyl having the structural formula:

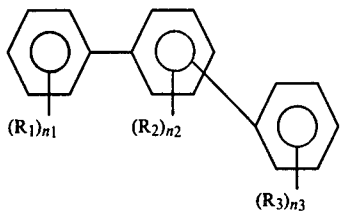

in which $R_1$, $R_2$, and $R_3$ represent identical or different linear or branched chain alkyl radicals containing from 1 to 5 carbon atoms, and $n_1$, $n_2$ and $n_3$, which may be identical or different, represent 0 or a number ranging from 1 to 3, with the proviso that the sum $n_1+n_2+n_3$ is at most equal to 4.

9. The dielectric composition as defined by claim 8, wherein each $R_1$, $R_2$ and $R_3$ is selected from the group consisting of methyl, ethyl, n-propyl, isopropyl, n-butyl, isobutyl, sec-butyl and t-butyl.

10. The dielectric composition as defined by claim 2, wherein the component [2] is comprised of the biphenyl or terphenyl sub-component (iii), which further comprises a member selected from the group consisting of mixtures of isomers, alkylaromatic hydrocarbons having different degrees of alkylation, and admixtures thereof.

11. The dielectric composition as defined by claim 10, wherein the degree of alkylation of the mixtures, expressed by the number of alkyl groups per molecule of biphenyl or of terphenyl, is at least 0.5.

12. The dielectric composition as defined by claim 2, wherein the component [2] is comprised of the biphenyl or terphenyl sub-component (iii), which sub-component comprises mixtures obtained by alkylation of biphenyl and terphenyls.

13. The dielectric composition as defined by claim 12, said sub-component [2] (iii) comprising unconverted starting material hydrocarbons.

14. The dielectric composition as defined by claim 2, wherein the component [2] is comprised of the partially hydrogenated hydrocarbon sub-component (iv).

15. The dielectric composition as defined by claim 14, the degree of partial hydrogenation being no greater than about 40%.

16. The dielectric composition as defined by claim 2, having a hydrogen index of less than 0.02.

17. The dielectric composition as defined by claim 2, further comprising an adjuvant selected from the group consisting of an antioxidant, a thickener, and a hydrochloric acid sequestering agent.

18. The dielectric composition as defined by claim 2, having a viscosity of less than about 15 centipoises at 60° C.

19. In a transformer, the improvement which comprises insulation/coolant material comprising the dielectric composition as defined by claim 1.

* * * * *